US007267101B2

(12) United States Patent
Garrick et al.

(10) Patent No.: US 7,267,101 B2
(45) Date of Patent: Sep. 11, 2007

(54) THROTTLE DEFAULT SYSTEM

(75) Inventors: Robert D. Garrick, Rochester, NY (US); Keith C. Guthrie, West Henriette, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/252,172

(22) Filed: Oct. 17, 2005

(65) Prior Publication Data

US 2007/0084438 A1 Apr. 19, 2007

(51) Int. Cl.
*F02D 11/10* (2006.01)

(52) U.S. Cl. ..... 123/396; 123/399

(58) Field of Classification Search ..... 123/339.1, 123/339.15, 339.23, 361, 396, 399
See application file for complete search history.

(56) References Cited

U.S. PATENT DOCUMENTS 4,438,049 A * 3/1984 Ammons ..... 123/339.1
4,541,378 A * 9/1985 Kitamura ..... 123/399
4,649,880 A * 3/1987 Asano et al. ..... 123/399
5,343,840 A * 9/1994 Wataya et al. ..... 123/399
5,419,293 A * 5/1995 Nagai ..... 123/396
5,629,852 A * 5/1997 Yokoyama et al. ..... 701/101
6,047,679 A * 4/2000 Matsumoto et al. ..... 123/396
6,092,505 A * 7/2000 Takahashi et al. ..... 123/399
6,167,867 B1 1/2001 Garrick
6,178,948 B1 1/2001 Garrick et al.
6,263,917 B1 7/2001 Evans
6,588,400 B2 7/2003 Gyoergy et al.
6,622,696 B2 9/2003 Witzel et al.
6,758,780 B2 7/2004 Witzel et al.
6,928,981 B2 8/2005 Garrick et al.
2004/0069271 A1* 4/2004 Kanno et al. ..... 123/396

* cited by examiner

*Primary Examiner*—T. M. Argenbright
(74) *Attorney, Agent, or Firm*—Paul L. Marshall

(57) ABSTRACT

An electronic throttle control unit includes an air bypass channel having a removable obstruction that opens in response to receiving an electronic throttle control fault signal and thereby allowing the vehicle a limp home condition. The throttle plate defaults to a fully closed position upon engine-off to substantially prevent evaporation and escape of hydrocarbons from the intake manifold to the atmosphere.

7 Claims, 2 Drawing Sheets

THROTTLE DEFAULT SYSTEM

TECHNICAL FIELD

The present invention relates to throttles for an internal combustion engine, and more particularly, to an electromechanical default system to allow air to bypass a closed throttle plate in response to an ETC fault signal.

BACKGROUND OF THE INVENTION

An electronic throttle control system (ETC) for controlling the amount of air to an engine is well known. The throttle valve plate of the throttle body pivots in response to signals received from the engine control unit (ECU) and thereby acts to regulate the amount of air delivered to the intake manifold. Throttle position sensors maintain the correct throttle position over the range of expected engine torque loads.

Prior art throttle plates are typically designed to default to a slightly open position (e.g., by about 10-20 degrees depending on the particular application) when in the engine-off condition or upon receiving an ETC fault signal. This is because there exists the possibility of the throttle plate becoming stuck in the fully closed position due to wintertime ice or carbon build-up in this area. Also, should the ETC malfunction, some air must be able to reach the intake manifold to allow the car a "limp home" condition for needed repairs. Thus, the prior art typically provides an ETC throttle system with a throttle plate that defaults to an open position in engine-off and ETC failure conditions. However, one serious drawback to a throttle open default position is that hydrocarbons remaining in the intake manifold are allowed to evaporate and escape into the atmosphere. Present day emissions regulations require throttle designs which substantially restrict the escape of hydrocarbons which would otherwise occur through an open throttle plate during engine-off or ETC failure conditions. Therefore, there exists a need for an ETC throttle body that gives the engine a limp home condition yet restricts the escape of evaporated hydrocarbons during engine-off and ETC failure conditions.

SUMMARY OF THE INVENTION

The present invention provides a throttle body having a default closed position for the throttle plate when in an engine-off condition to substantially prevent the escape of hydrocarbons into the atmosphere, and further includes an air bypass channel that opens in response to an ETC failure condition (with engine on) to allow the automobile a limp home condition.

More particularly, the throttle body is provided with a bypass air channel extending from the inlet end of the throttle bore to the outlet end radially outwardly of the main throttle bore wherein the throttle plate is located. The bypass is normally closed and will open only in response to receiving a signal that the ETC has malfunctioned with the engine running.

Any desired and appropriate mechanism may be used for the closing and subsequent opening of the bypass. For example, and not by way of limitation, the mechanism could be an electromechanical valve such as a poppet valve or a solenoid valve; a wax plug or other material that falls away upon application of an electric charge or change in air or mechanical pressure.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
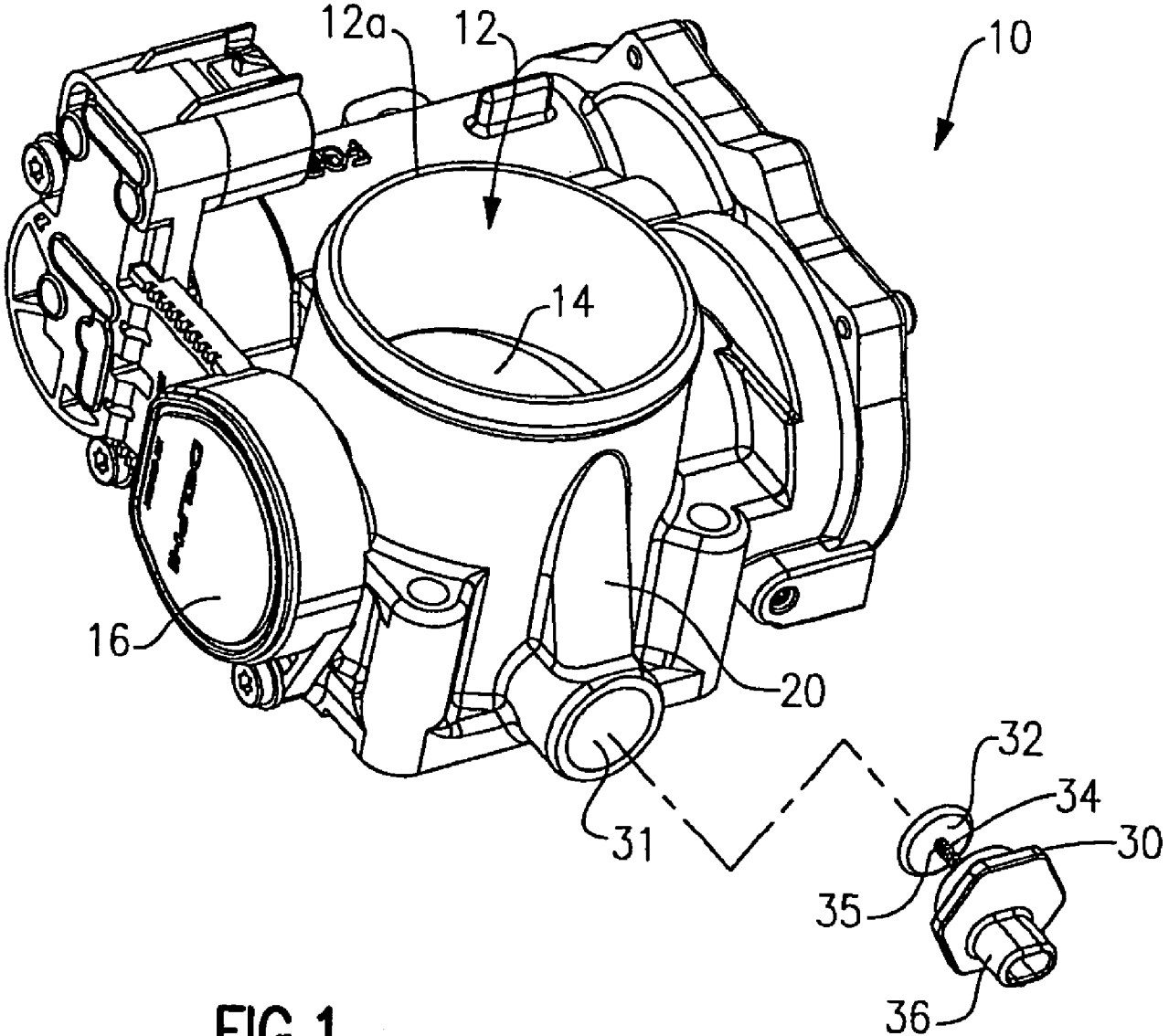
FIG. 1 is a perspective view of an electronic throttle control unit in accordance with the invention.
Figure 2:
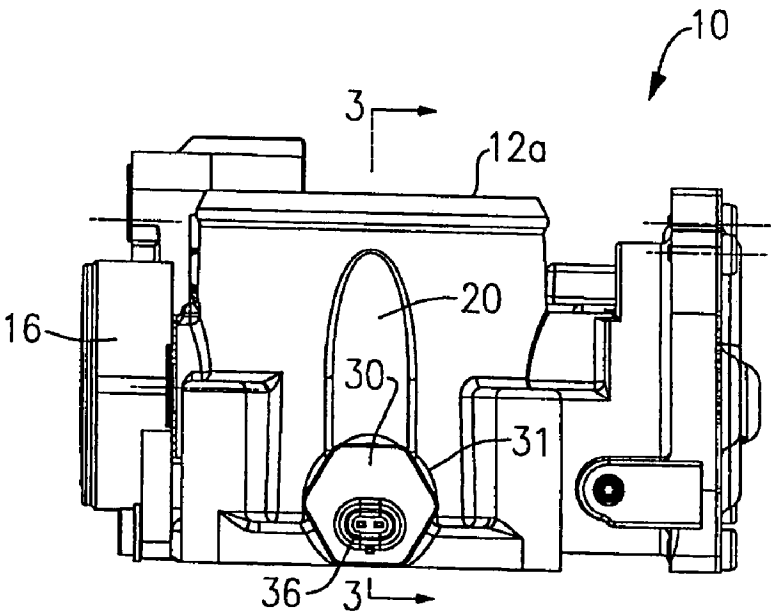
FIG. 2 is a side elevational view thereof.
Figure 3:
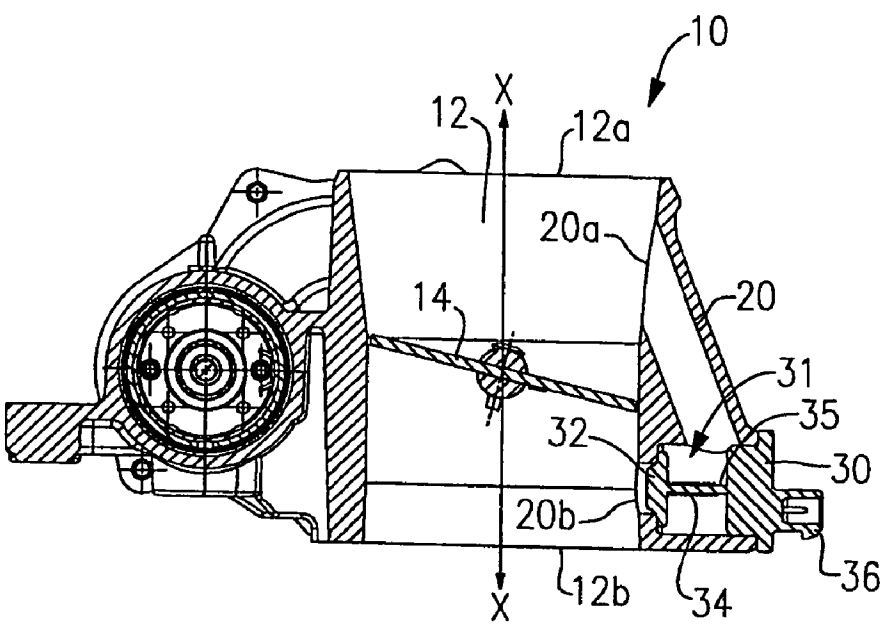
FIG. 3 is a cross-sectional view as taken generally along the line 3-3 of FIG. 2.

As seen in FIGS. 1-3, an electronic throttle control unit (hereinafter "ETC") indicated generally by the reference numeral 10 is provided for controlling the amount of air delivered to an internal combustion engine (not shown). In operation, ETC 10 is connected to the engine's computer, also known as an engine control unit or "ECU" (also not shown). ETC 10 operates in response to signals received from the ECU as is known in the art and as described more fully below.

ETC 10 includes a main throttle bore 12 having an inlet end 12*a* and an outlet end 12*b* which connects to the air intake manifold of the engine. Outside air is thus delivered through throttle main bore 12 to the engine's air intake manifold and mixes with fuel to power the engine in a well known manner. A throttle plate 14 is pivotally secured within main bore 12 and is movable through connection of an actuator 16 which may be a DC brush motor, for example. Actuator 16 responds to signals received from the ECU to pivot throttle plate 14 between a fully closed position as seen best in FIG. 3, and a fully open position where plate 14 extends parallel to the longitudinal axis X-X of main throttle bore 12.

When in the fully closed position, throttle plate 14 essentially seals throttle bore 12 such that no air is allowed therethrough and the engine is thus not running. Conversely, the fully open position of the throttle plate allows the maximum amount of air through the throttle bore 12 to power the engine. Positions between fully open and fully closed are dictated by the ECU which moves the throttle plate 14 via actuator 16 based on the engine load condition.

As explained in the Background section hereof, many prior art throttle bodies are designed to default to a slightly open position rather than a fully closed position. This is because of the fear that the throttle plate may get stuck in the fully closed position, and also to allow some air to reach the engine in case the ETC actuator fails, thereby allowing a limp home condition for needed repairs. Unfortunately, this open throttle position also allows the intake manifold to be exposed to the ambient leading to the evaporation and escape of hydrocarbons into the environment when the engine is not running. Present day federal emissions regulations require these emissions be eliminated or at least significantly reduced from previously seen levels.

The present invention addresses the above noted concerns by having the throttle plate 14 default to the fully closed position when the engine is not running and/or the ETC actuator 16 fails. With the throttle plate 14 fully closed (FIG. 3), evaporated hydrocarbons are substantially blocked from escaping the intake manifold and through the main throttle bore to inlet end 12*a* thereof.

In particular, the invention provides a throttle air bypass channel 20 having an inlet end 20*a* and outlet end 20*b* extending between and adjacent the throttle main bore inlet end 12*a* and outlet end 12*b*, respectively, and radially outwardly of main throttle bore 12. As such, when channel 20 is unobstructed and open, air may bypass main throttle bore 12 (and thus also closed throttle plate 14) by flowing from channel inlet end 20*a* to outlet end 20*b* and thereby reach the engine intake manifold.

A removable obstruction is positioned in channel 20 such that channel 20 is normally closed. The obstruction is automatically removed (and thus channel 20 is opened) upon the occurrence of a fault being detected in the ETC. As used herein, the terms "removable" and "removed" are meant to indicate a condition where the obstruction is no longer blocking or sealing off channel 20 and may or may not involve actual physical separation of the obstruction from the throttle body. It is furthermore understood that all necessary components and connections, according to the selected obstruction type, are included to allow the obstruction to receive and respond to an ETC fault signal.

In the embodiment of the invention shown in FIGS. 1-3, the obstruction is in the form of a poppet valve 30 positioned in laterally extending channel bore 31. Poppet valve 30 has a valve seat 32 at the end of spring 34 on shaft 35, seat 32 closing off channel outlet end 20*b* when in the normally extended position shown. Thus, during normal engine operating conditions, poppet valve 30 obstructs bypass channel 20 such that no air is allowed to pass therethrough. While the engine is running, air flows normally through throttle main bore 12 and past throttle plate 14 which pivots according to the signals received from the ECU as discussed above. When the engine is not running (engine-off), the throttle plate 14 pivots to the default position of fully closed. As such, no evaporated hydrocarbons are passed through throttle bore 12 into the atmosphere during engine-off condition. Upon receiving a signal of ETC fault, for example via valve electrical connector 36, poppet valve 30 opens by valve seat 32 moving with the assistance of spring 34 (to the right in FIG. 3). As such, the obstruction (the valve seat 32) is removed and bypass channel 20 is open to allow air to travel from the inlet end 20*a* thereof to the outlet end 20*b* thereof, ultimately reaching the intake manifold to allow a limp home condition.

While the invention has been described by reference to various specific embodiments, it should be understood that numerous changes may be made within the spirit and scope of the inventive concepts described. For example, although the invention has been described and shown with a poppet valve as the removable obstruction, it is understood that any device capable of normally obstructing and then automatically opening channel 20 in response to receiving an ETC fault signal would be suitable. A few possible examples include a plug of material (e.g., wax or a fusible metal alloy) that, under normal operating conditions, maintains the channel 20 plugged and closed, yet automatically opens the channel 20 upon receiving an ETC fault signal (e.g., by reducing in size, disintegrating, or otherwise moving away from the closed position in channel 20).

Accordingly, it is intended that the invention not be limited to the described embodiments, but will have the full scope defined by the language of the following claims.

What is claimed is:

1. An electronic throttle control for use with an internal combustion engine having an engine control unit, said electronic throttle control operable to receive and respond to an electronic throttle control fault signal received from said engine control unit, said electronic throttle control comprising:

a) a throttle body having a main throttle bore extending between a throttle bore inlet end and a throttle bore outlet end;

b) a throttle plate pivotally secured in said main throttle bore and movable between fully open and fully closed positions in response to signals received from said engine control unit, wherein said throttle plate defaults to the fully closed position to seal said main throttle bore between said throttle bore inlet end and said throttle bore outlet end to prevent the escape of hydrocarbons through said throttle bore inlet end of said main throttle bore when the engine is off;

c) a bypass channel having an inlet end and outlet end extending between and adjacent said main throttle bore inlet end and outlet end, respectively, said bypass channel positioned radially outwardly of said throttle main bore; and d) a removable obstruction positioned in said bypass channel such that said channel is normally closed to prevent air from traveling between said channel inlet end to said outlet end, said obstruction being automatically removed upon receiving said electronic throttle control fault signal from said engine control unit.

2. The electronic throttle control of claim 1, wherein said obstruction comprises a poppet valve.

3. The electronic throttle control of claim 2, wherein said channel includes a laterally extending channel bore wherein said poppet valve is located.

4. A method of controlling the amount of air through an electronic throttle control unit having a throttle plate pivotally secured in a main throttle bore including an inlet end and an outlet end for connecting to an intake manifold of an engine, said method comprising the steps of:

a) causing said throttle plate to default to a fully closed position to seal said main throttle bore between said inlet end and said outlet end to prevent the escape of hydrocarbons through said inlet end of said main throttle bore when the engine is turned off or upon receiving an electronic throttle control fault signal;

b) providing a bypass channel having an inlet end and an outlet end extending between and adjacent said main throttle bore inlet end and outlet end, respectively, said bypass channel located radially outwardly of said main throttle bore; and c) providing a removable obstruction in said channel to prevent air from traveling between said bypass channel inlet end and outlet end, said removable obstruction opening in response to receiving said electronic throttle control signal, said opening thereby allowing air to travel between said channel inlet end and outlet end.

5. The method of claim 4 wherein said obstruction is a poppet valve.

6. The method of claim 4 and further comprising the step of forming a laterally extending bore in said bypass channel wherein said removable obstruction is positioned.

7. The method of claim 6 wherein said removable obstruction is a poppet valve.

* * * * *